United States Patent [19]

Faupell et al.

[11] Patent Number: 4,867,393

[45] Date of Patent: Sep. 19, 1989

[54] REDUCED FIN SPAN THRUST VECTOR CONTROLLED PULSED TACTICAL MISSILE

[75] Inventors: Lawrence C. Faupell, Logan; Steven R. Wassom, Smithfield, both of Utah

[73] Assignee: Morton Thiokol, Inc., Chicago, Ill.

[21] Appl. No.: 233,069

[22] Filed: Aug. 17, 1988

[51] Int. Cl.[4] ..... F42B 15/027; F42B 15/033

[52] U.S. Cl. ..... 244/3.22; 244/3.24; 239/265.19

[58] Field of Search ..... 244/3.22, 3.24, 3.21; 239/265.19, 265.35

[56] References Cited

U.S. PATENT DOCUMENTS

| | | | |
|---|---|---|---|
| 2,996,267 | 8/1961 | Warren | 244/3.22 |
| 4,044,970 | 8/1977 | Maudal | 244/3.22 |
| 4,163,534 | 8/1979 | Seeger | 244/3.22 |
| 4,560,121 | 12/1985 | Terp | 244/3.22 |
| 4,709,877 | 12/1987 | Goulding | 244/3.28 |

FOREIGN PATENT DOCUMENTS

| | | | |
|---|---|---|---|
| 857540 | 12/1960 | United Kingdom | 244/3.21 |

*Primary Examiner*—Deborah L. Kyle
*Assistant Examiner*—Michael J. Carone
*Attorney, Agent, or Firm*—James C. Simmons; Gerald K. White

[57] ABSTRACT

A tactical pulsed missile with a movable nozzle for thrust vector control and movable aerofins to provide greater maneuverability and flexibility. The first pulse is fired at launch and the later pulses are fired as needed whereby steerage may be provided by thrust vector control during the firing of the pulses. When none of the pulses are firing, steerage may be provided by the movable aerofins. The missile is provided with separate small electromechanical actuators for each of the aerofins and each of the movable nozzle axes which are preferably placed closely adjacent the respective aerofins and nozzle so that the weight and space of various linkages may be eliminated. The motors are provided with a source of high voltage so that their size may be reduced whereby they burn up when the high voltage is applied for a short period of time but not before their task has been achieved. The fin span is reduced to less than about four inches to enable the packaging of a greater number of such tactical missiles in the payload bay of an airplane. A flexible bearing may be provided between the nozzle and nozzle housing. An elastomeric material may be provided between and bonded to the nozzle and nozzle housing to prevent the ingestion of exhaust and debris into the space therebetween.

9 Claims, 9 Drawing Sheets

REDUCED FIN SPAN THRUST VECTOR CONTROLLED PULSED TACTICAL MISSILE

The present invention relates generally to guided missiles.

As targets become increasingly more maneuverable, highly maneuverable missiles that are light in weight and have adequate range capability are required. Tactical missiles have commonly been provided with aerodynamic surfaces in the form of fixed strakes and movable fins for lift, stability, and guidance. The steerage capability of the movable fins or aerofins is dependent upon the dynamic pressure, i.e., the atmospheric density times the velocity squared. The greater the dynamic pressure, the more effective is the steerage of a missile by the aerofins. It is considered desirable to improve the capability of such missiles to intercept high altitude targets, i.e., those at altitudes over about 70,000 feet, where the dynamic pressure is low. It is also desirable to improve the guidance capability of such missiles at low speeds where the dynamic pressure is also low.

In order to accomplish the above objectives, it is desirable to provide a movable thrust nozzle for thrust vector control on such missiles for effective steerage at low dynamic pressures. Although movable thrust nozzles have been provided commonly on strategic missiles, weight and space limitations have curtailed their use on tactical missiles. In general, a tactical missile may be differentiated from a strategic missile in that a tactical missile is capable of being carried in a payload bay of an airplane or on a ship and generally has a diameter of up to about 15 inches. For the purposes of this specification and the claims, a tactical missile is defined as one which has a case diameter of less than about 20 inches. For such small missiles, actuators for the movable nozzle have been considered too bulky and heavy. As discussed in "Optimal Thrust Control with Proportional Navigational Guidance" by Anthony J. Calise, J. Guidance and Control, Vol. 3, No. 4, July–Aug., 1980, page 312, > "Thrust vector control (TVC) can be used to augment lift and provide stable flight at high angles-of-attack without large aerodynamic control surfaces. However, TVC is inefficient from an energy point of view, and the gimballed nozzle and complex autopilot design requirements inexorably lead to increased weight and cost."

Whereas the movable aerofins are effective for steering when the dynamic pressure is sufficient, the movable thrust nozzle is effective for steering only when solid propellant therein is being fired to produce thrust. However, for typical solid propellant rocket motors which have a single mass of solid propellant, the combustion process will proceed without the ability to stop it until the entire mass of ignited propellant has been consumed after which the movable nozzle will no longer be effective for steerage. In order to allow management of the expenditure of the propulsive energy over the duration of a flight for enhanced performance and flexibility, pulsed rocket motors have been provided wherein within the same case two or more solid propellant units such as a boost grain and a sustain grain separated by a membrane seal structure enable the ignition of the propellant units to be independent of each other whereby discrete impulses are available upon command. Such a pulsed rocket motor is disclosed in U.S. patent application 813,819, which is to issue on Aug. 30, 1988, as U.S. Pat. No. 4,766,726 to Tackett et al, which is assigned to the assignee of the present invention and which is hereby incorporated herein by reference. Pulsed rocket motors are also disclosed in U.S. Pat. Nos. 3,888,079 to Diesinger and 2,856,851 to Thomas, which patents are also incorporated herein by reference. However, as previously discussed, the increased weight and volume taken up in tactical missiles by typical actuators for movable nozzles has precluded their use along with the use of movable fins for steerage of pulsed tactical missiles.

Another problem faced by tactical defense planners has been that of increasing weapons loadout on an airplane. Referring to FIG. 1, there is illustrated this problem wherein the payload bay illustrated at A of an aircraft B is shown to contain only one tactical missile C. It is considered desirable to increase the weapons loadout for more effective use of the aircraft B as shown in FIG. 2 wherein a greater number such as perhaps nine missiles D, each having the same case diameter as the case diameter of missile C, can be loaded in the payload bay A. Thus, it is considered desirable to be able to package several missiles of the same case diameter into an area formerly occupied by only one missile.

It is therefore an object of the present invention to provide a tactical missile wherein the loadout thereof in the payload bay of an aircraft is increased.

It is another object of the present invention to provide such a tactical missile which has an increased capability of intercepting high altitude targets and of being guided at low speeds.

It is a further object of the present invention to provide such a tactical missile wherein the actuation devices for a movable thrust nozzle therefor are of light weight and take up little space.

These and other objects of the invention will become apparent in the following detailed description of the preferred embodiments of the invention taken in conjunction with the accompanying drawings.

IN THE DRAWINGS

FIG. 11 is a block diagram of the electronics system for an actuator of the thrust vector actuator system, the electronics system for each actuator of the aerofin actuator system being similar.

DETAILED DESCRIPTION OF THE PREFERRED EMBODIMENTS

Figure 4:
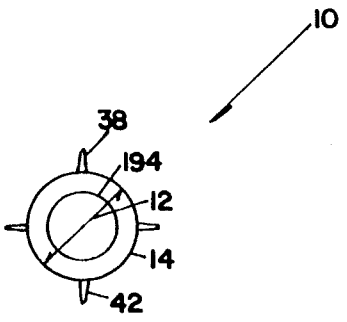
FIG. 4 is an aft end view of the missile of FIG. 3.
Figure 3:
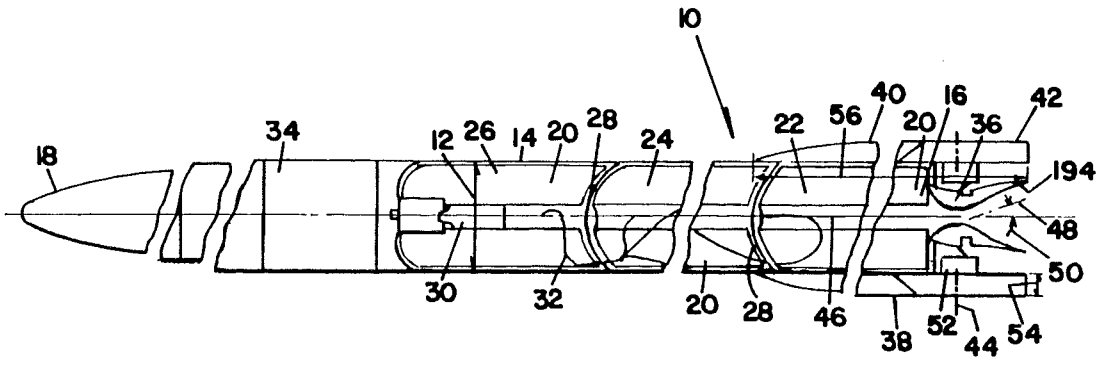
FIG. 3 is a schematic longitudinal view of a missile which embodies the present invention.

Referring to FIGS. 3 and 4, there is illustrated generally at 10 a missile which includes an elongate generally cylindrical case 14 which is open at its aft end 16, and its forward end 18 tapers slightly to a closed end. The case may be composed of any suitable material such as stainless steel or a composite of a resin impregnated fibrous material such as carbon, fiberglass, or aramid fibers. The missile 10, which is a tactical missile, has a case diameter illustrated at 12 of less than about 20 inches.

Within the case 14 is contained solid propellant material 20 which is separated into three discrete grains or pulses 22, 24, and 26 in end-to-end relation by suitable barriers such as those known as membrane seal assemblies illustrated at 28. It should be understood that, in accordance with the present invention, the case may contain any plural number of grains. Each pulse has a separate igniter illustrated at 30 for igniting the propellant 20 therein. Only the igniter 30 for the third or forward most pulse 26 is illustrated which is mounted in the domed closed forward end thereof, each of the other pulses 22 and 24 being provided with a similar igniter mounted in the respective membrane seal assembly 28. Each igniter 30 is connected through leads 32 to a source of electrical or laser power (not shown), the ignition times being controlled by a guidance and control system in accordance with principles commonly known to those of ordinary skill in the art to which this invention pertains.

Each pulse is, as previously stated, separated from each subsequent pulse by a membrane seal assembly 28 or other suitable means to enable the ignition of the solid propellant grains to be independent of each other whereby discrete impulses are available upon command. The membrane seal assembly 28 extends over the inner diameter of the rocket motor case 14 and is suitably attached thereto. Each of the membrane seal assemblies may, for example, be similar to those which are shown and described in greater detail in the aforesaid U.S. patent application which is to issue as U.S. Pat. No. 4,766,726 or the aforesaid U.S. Pat. No. 3,888,079. The membrane seal assembly 28 may include a bulkhead which includes a plurality of apertures for flow of combustion gases therethrough and may also include a thin imperforate metallic membrane or cover of high strength but ductile material which covers the aft side of the bulkhead to seal the forward chamber or pulse from flow of gases thereinto upon ignition of the solid propellant grain in the aft chamber or pulse and which, after the solid propellant grain in the aft chamber or pulse has been expended, pressure resulting from combustion of the solid propellant grain in the forward chamber or pulse upon ignition thereof at a selected time will cause the thin membrane to rupture and thus allow the escape of gases from the forward chamber or pulse through the apertures in the bulkhead to the aft chamber or pulse and then out the nozzle to produce thrust. In the space 34 forward of the forward pulse 26 are loaded the payload, avionics and cooling apparatus, seekers, and any other apparatus which it is desired that the missile 10 carry.

Attached to the aft end 16 of the case 14, in flow communication with the grain 20 of the aft or first pulse 22 and also in flow communication with gases generated by each subsequent pulse 24 and 26 when the membranes of the membrane seal assemblies 28 are respectively ruptured, is a thrust nozzle 36 to which is attached an exit cone 194. As best shown in FIG. 4, a plurality such as four aerodynamic surfaces illustrated at 38 spaced circumferentially about the aft end 16 of the case 14 approximately 90° apart extend radially outwardly from the case 14 and are integrally or otherwise suitably attached thereto. The aerodynamic surfaces 38 include non-movable strakes 40 for providing lift and stability and, aft thereof, aerofins 42 which are movable about a radial axis illustrated at 44 for providing steerage or trim attitude control, that is, pitch (up and down movement), yaw (movement about a vertical axis), and roll.

As the dynamic pressure (atmospheric density times velocity squared) increases, a greater amount of steerage is available from the aerofins 42. But the steering effectiveness of the aerofins is reduced as the dynamic pressure is decreased. In order to provide increased steerage of the missile at times when the dynamic pressure is low as well as to provide increased steering capability for significant maneuvering such as during terminal homing, apparatus is provided as will be described in greater detail hereinafter for moving the thrust nozzle 36 omniaxially with respect to the missile 10 for thrust vector control during the times when one of the pulses 22, 24, or 26 is being fired. Thus, the nozzle 36 may be pivoted about a point, i.e., the center of a bearing interface, as hereinafter described, at the throat 39, so that its center line is positioned omniaxially with respect to the missile 10, that is, the nozzle 36 may be positioned so that its axis is at a small angle in any direction relative to the longitudinal axis 46 of the missile 10 to direct gas flow outwardly at different angles in all directions to cause a reaction force and large turning moment, for high maneuverability, for turning the missile. For example, although the nozzle 36 is positioned in FIG. 3 so that its axis is the same as the missile axis 46, it may be positioned such that its axis illustrated at 48 is at an angle 50 up to perhaps 15° in any direction relative thereto for purposes of steerage of the missile 10 during a time when one of the pulses is being fired. However, the thrust nozzle 36 does not provide any steerage capacity during times when none of the pulses are being fired. During those times, the movable aerofins 42 are provided to provide steerage. Thrust vector control provided by the movable nozzle 36 is thus needed most at high altitudes and/or low speeds where the dynamic pressure is lower than perhaps about 100 lbs. per square foot.

Figure 12:
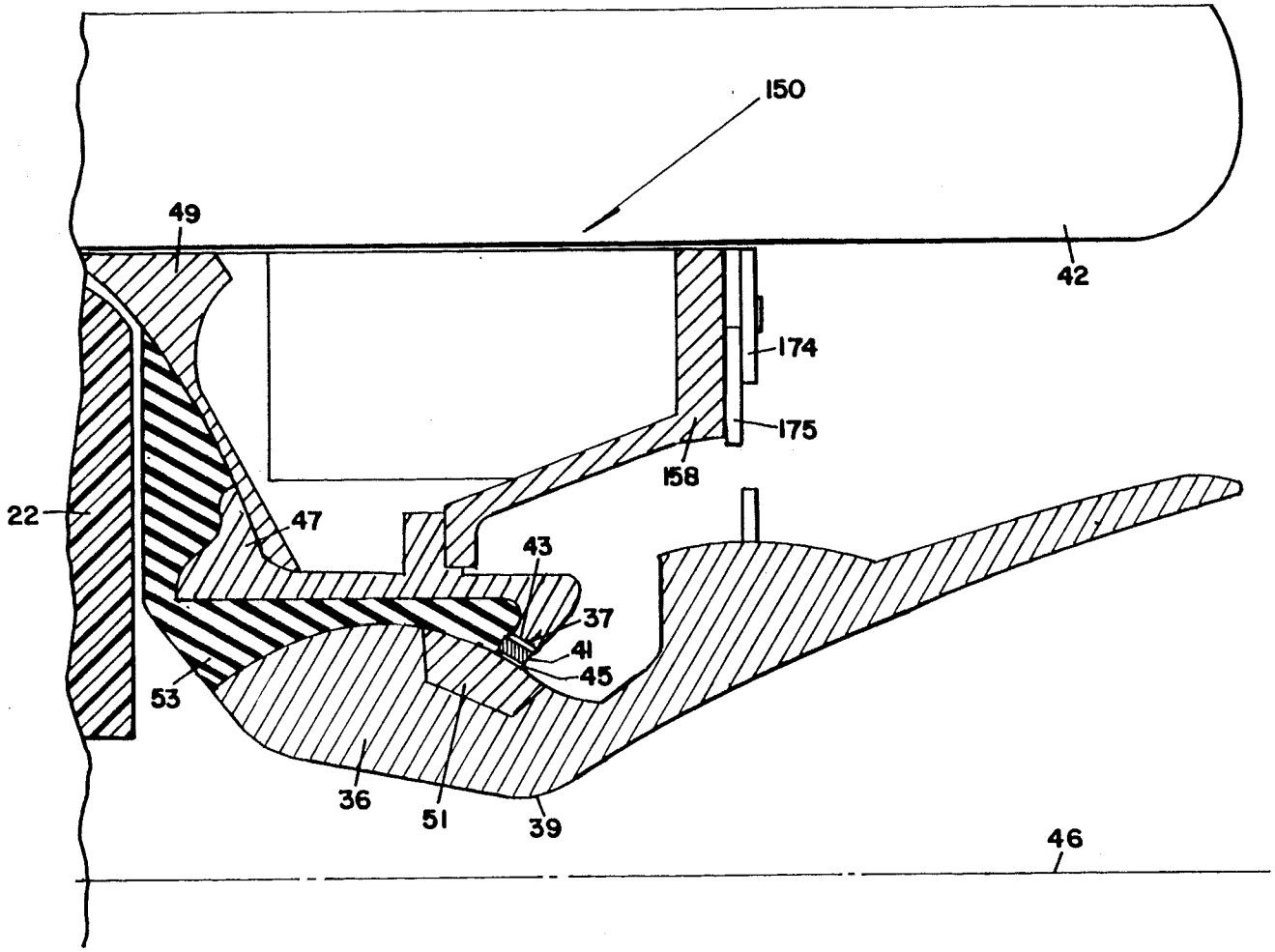
FIG. 12 is a detailed longitudinal view illustrating the mounting of the movable nozzle of the missile shown in FIG. 3.

The nozzle bearing interface with the case 14 may be, as best shown in FIG. 12, a bonded elastomeric material known as a flexible bearing or flexbearing 37 to allow its pivoting about its pivot point for positioning it omniaxially. The flexbearing 37 comprises a reinforcing laminate 41 of shim stock of steel or other suitable material sandwiched between and suitably bonded to a pair of elastomeric pads 43 and 45 composed of natural rubber, polyisoprene, polyurethane, silicone, or other suitable elastomeric material. The other surface of one pad 43 is suitably bonded to fixed housing 47 which is fixedly attached to aft closure member 49 which is fixedly attached to rocket motor case 14. The other surface of the other pad 45 is suitably bonded to a movable housing or carrier element 51 which is composed of a solid insulator ablative structural material such as a combination of steel and carbon phenolic which is suitably inlaid in the nozzle 36 for support of the flexbearing 37.

It there is an open area, which may be called a split line, between the movable nozzle 36 and fixed nozzle housing and aft closure 47 and 49 respectively, exhaust and debris may be ingested in the space therebetween to disadvantageously cause damage or impede motion of the nozzle. In order to prevent this space from ingesting exhaust or debris in accordance with the present invention, a soft elastomeric material 53 having a large deflection and ablative capability such as, for example, a phenol based silicone foam, is bonded to the fixed housing 47 and to the nozzle 36 including the inlaid structural member 51 whereby the elastomeric material 53, which may be called a split line protector, may suitably stretch and contract as the nozzle is slewed. If desired, a liquid silicone or other suitable liquid may be encapsulated in the elastomeric material 53 to allow motion thereof without high compression thereof.

Depending on the load and other applied conditions, it may be necessary to provide more than one laminate alternately sandwiched between elastomeric pads to better handle the applied conditions. However, if it can adequately handle the applied conditions, the flexbearing may be composed of only a single elastomeric pad. In order that the flexbearing 37 have minimum size while having the capacity to handle the applied conditions, for example, compressive stresses over 5000 psi and shear strains over 400 percent simultaneously, it is desired that the elastomer/metal interfaces be maintained parallel so that, during nozzle deflection, there is not a large tensile load at one edge of the elastomer and a large compressive load at the other edge. By distributing the load equally over the whole interface of the elastomeric elements, higher compressive loads can be tolerated. Whether or not the load is equally distributed during nozzle deflection may be confirmed by finite element analysis, a procedure known to those of ordinary skill in the art to which this invention pertains. Thus, the flexbearing may be built with fewer elastomeric elements for reduced size, weight, and cost to safely provide greater deflection, i.e., about 15 degrees.

Alternatively, it may be desirable to use a ball and socket arrangement instead of a flexbearing for the bearing interface with the nozzle. For example, a trapped ball bearing, such as described in U.S. Pat. No. 4,157,788 to Canfield et al and assigned to the assignee of the present invention which patent is hereby incorporated herein by reference, may be used.

The aerofins 42 are preferably symmetric about the radial axis 44 so that the amount of power required to move them may be minimized. The strakes 40 are sized to have a sufficient amount of surface area in accordance with principles commonly known to those of ordinary skill in the art to which this invention pertains for the required lift and stability.

The missile 10 is multi-pulsed in order that it may have an ability to fire more than once so that the expenditure of propulsive energy over the duration of the flight may be managed for enhanced performance and, with the use of the movable nozzle for thrust vector control, enhanced maneuvering flexibility. The first pulse 22 is fired to launch the missile 10, and the ignition times of the other pulses 24 and 26 are controlled by the guidance and control system (not shown) to optimize performance criteria such as maximum terminal velocity or maximum f-pole. The f-pole may be defined as the distance between the launch aircraft and the target at the time of target intercept. It is usually desired that the f-pole not be within range of the target since the target may be able to counter-attack if the f-pole is within its range. If high acceleration maneuvers are not required in the intercept phase, then all of the remaining pulses 24 and 26 may be fired during mid-course for maximum range, or the final pulse 26 can be saved until terminal homing to increase maneuverability during that phase.

The nozzle 36 and aerofins 42 are positioned by an integral aerofin/thrust vector control actuation system, generally illustrated at 52 and which will be described in greater detail hereinafter, which receives position command signals from the guidance and control system (not shown) and uses battery powered electric motors to move the nozzle and aerofins. Feedback sensors and electronic logic measure actual position, compare actual to commanded position, and send appropriate error signals to the actuators to adjust position, as will be discussed more fully hereinafter.

Figure 1:
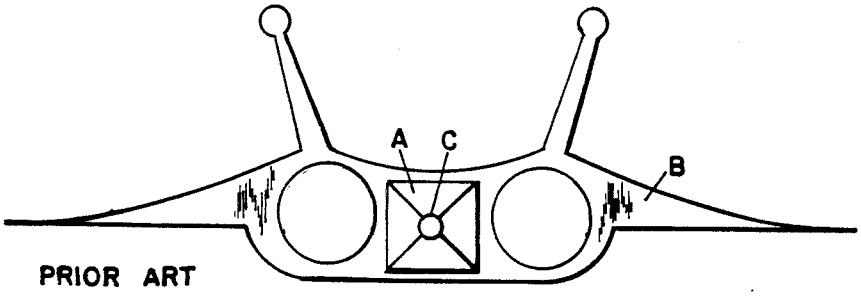
FIG. 1 is a schematic view illustrating the load out of the payload bay of an aircraft with a missile of the prior art.
Figure 2:
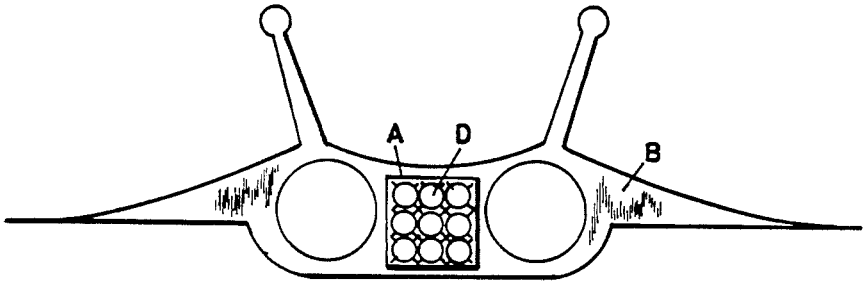
FIG. 2 is a view similar to that of FIG. 1 illustrating the load out of the payload bay with missiles according to the present invention which have the same case diameter as the missile shown in FIG. 1.

Tactical missiles typically have an aerodynamic surface span, the distance illustrated at 54 which a fin 42 and strake 40 extends radially outwardly from the missile case 14, which is about eight inches or greater. The aerodynamic surface span 54 may be referred to hereinafter as fin span. As used herein, fin span is meant to also include the strake span. The term "aerodynamic surface" is meant to include both the movable fin 42 and the strake 40. The range of the missile 10 may be reduced due to greater drag as the fin span 54 is increased. In addition, the greater the fin span 54, the lesser number of missiles 10 which can be provided in a payload bay of a given size, as illustrated in FIGS. 1 and 2. In order to provide reduced drag for greater range as well as to enhance the packaging of missiles as weapons aboard aircraft in accordance with the present invention, the fin span 54 is reduced so that the missile 10 has a fin span 54 of less than about four inches. Thus, with a decreased fin span 54, a greater number of missiles of the same case diameter 12 can be packaged in a payload bay, as illustrated in FIG. 2. For example, the missile 10 of FIGS. 3 and 4 may have a case diameter 12 of eight inches and a fin span 54 of two inches.

Figure 5:
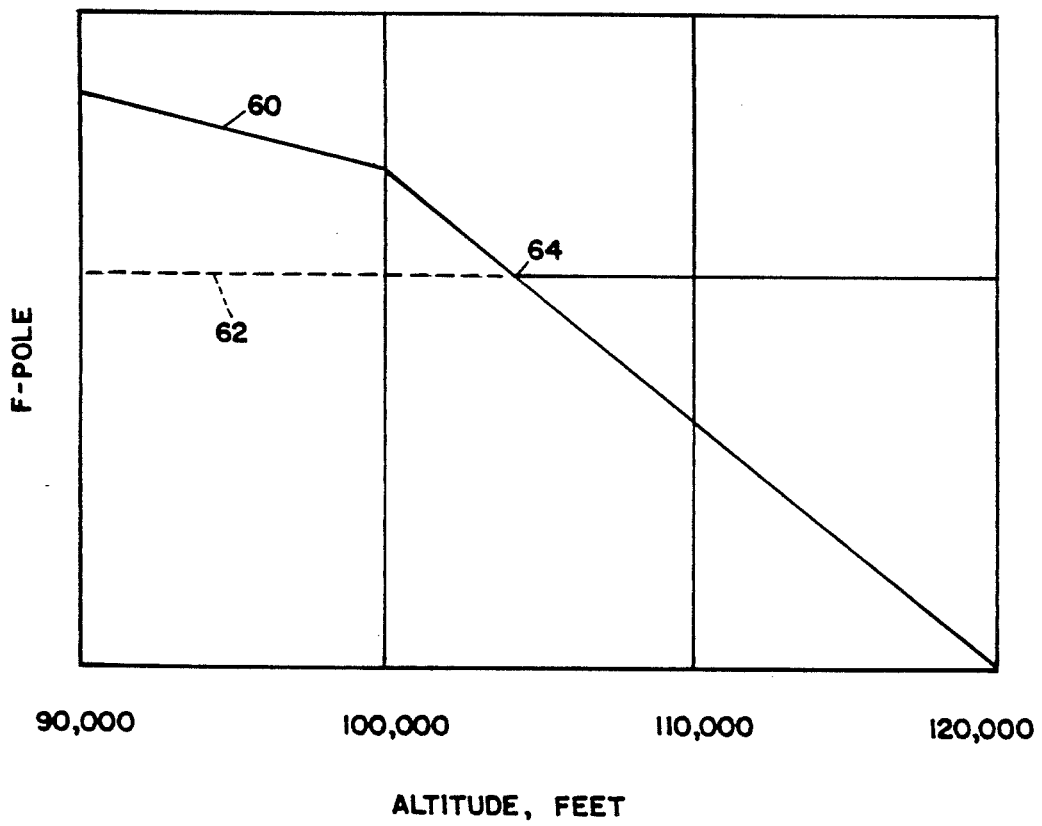
FIG. 5 is a graph illustrating the f-Pole at various altitudes for a missile with thrust vector control and a terminal pulse and for a missile with no thrust vector control wherein the pulses are fired in mid-course.

FIG. 5 illustates the advantage and additional capability of using a pulsed missile with thrust vector control. The f-pole is affected by a decision to either fire all remaining pulses during the mid-course phase of flight or to save the final pulse until the terminal phase. Saving the final pulse until the terminal phase would normally only be desirable if the missile had thrust vector control for increased maneuverability during that phase. As previously discussed, it is desirable to obtain a maximum f-pole since the target may be able to counter-attack if the f-pole is within its range. Line 60 illustrates the f-pole at various target altitudes for a missile with no thrust vector control wherein the remaining pulses are optimally fired in mid-course. Line 60 illustrates that a larger f-pole is obtained at a lower target altitude of perhaps 90,000 feet or less, and then decreases as the altitude increases. Line 62 illustrates the f-pole at various target altitudes for a missile with thrust vector control wherein the final pulse is fired during the terminal phase. Line 62 illustrates that the f-pole remains almost constant as the target altitude increases. As illustrated in FIG. 5, below a certain target altitude illustrated at point 64, such as perhaps 105,000 feet, the maximum f-pole is obtained by firing the remaining pulses in mid-course. Above the target altitude 64, the f-pole may be increased by saving the last pulse until the terminal phase and using it in conjunction with thrust vector control. Thus, a missile with thrust vector control may be utilized to fire the remaining pulses in mid-course if the target altitude is low, i.e., below the target altitude at point 64, and to use the last pulse in the terminal phase at target altitudes above that altitude for enhanced missile flexibility and increased effective service ceiling of the missile.

Even at low altitudes such as 20,000 feet, it is difficult without the use of thrust vector control to intercept an enemy approaching from behind. The use of a movable nozzle for thrust vector control and movable aerofins on a tactical missile in accordance with the present invention is also provided to enhance the flexibility by enabling rear-hemisphere defense.

Figure 6:
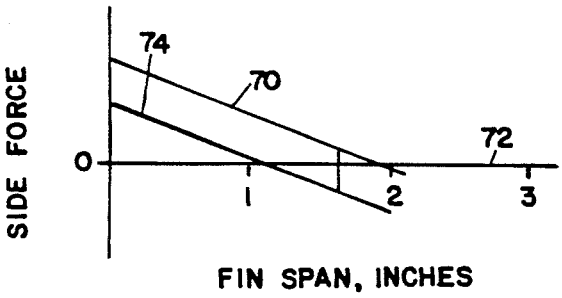
FIG. 6 is a graph which illustrates at launch and at burnout the side force required to trim a missile at various aerodynamic surface spans.

The dimensions of the strakes 40 and aerofins 42 determine the location of the center of pressure (CP) on the missile. The mass distribution in the missile determines the location of the center of gravity (CG). The magnitude of the turning moment due to the relative wind is proportional to the distance between the CP and CG while the moment direction is determined by the CP being forward or aft of the CG. The steering system (movable nozzle 36 and aerofins 42) must be capable of providing enough turning moment to overcome the moment due to the wind. Thus, it is considered desirable to size the aerodynamic surfaces 38 so that the CP and CG nearly coincide to thus minimize the steering effort required. As the propellant 20 is consumed, the CG shifts. It is thus desired that the aerosurfaces 38 be sized so that the CG shift is symmetric about the CP whereby the actuator systems, as hereinafter described, may have less horsepower requirements and thus may be reduced in size. In FIG. 6, line 70 illustrates the amount of side force required at launch to hold the desired missile attitude with various fin spans 54, line 72 representing zero side force. Line 74 represents the required side force to hold the desired missile attitude with various fin spans 54 at burnout. FIG. 6 illustrates an example in which the CG at launch and at burnout are symmetric about the CP for a fin span of about 1.6 inches whereby the magnitude of the required side force may be the same for launch and burnout, while having an opposite force vector direction. For example, missile 10 may have a diameter of eight inches, a length of 144 inches, a weight of 400 pounds, a moment arm (distance between the CG and the pivot point of the nozzle 36) of approximately 60 inches, have a strake chord, illustrated at 56, which is the combined length axially of the missile of the strake 40 and fin 42, of about 33 inches, and have a fin span 54 of about 1.6 inch for use optimally at a speed and altitude of mach 4 and 70,000 feet. Although as the fin span 54 decreases, the stability decreases, this decrease in stability may be compensated for and the missile maintained stable by movements of the movable aerofins 42 and the movable nozzle 36 whereby greater flexibility is provided for maintaining stability. Thus, it is preferred that each of the aerodynamic surfaces 38 have a fin span 54 such that the required side force vector on the missile at burnout is the same magnitude and of opposite direction as the required side force vector on the missile at launch.

One of the problems in providing thrust vector control on small diameter tactical missiles has been the difficulty in accommodating the increased weight and space of the actuation devices therefor. Further, the use of either an hydraulic or pneumatic actuation system or one in which a single motor serves several functions has undesirably resulted in requirements for increased weight and space for the various linkages and the like required. In accordance with the present invention, the actuation system is reduced in size as hereinafter described to also allow a larger volume of propellant and thus a higher total impulse. By thus reducing the size of the actuation system, the blast tube may be reduced in size or eliminated to allow a significant increase in the amount of propellant that can be loaded into a given overall motor length. For movement of the nozzle 36 omniaxially, means must be provided for moving it in an X or pitch direction and in a Y or yaw direction which is perpendicular thereto. The pitch and yaw directions are illustrated at 186 and 182 respectively in FIG. 10. In order to reduce the linkage space required in accordance with the present invention, each of the aerofins 42 is controlled by a separate motor which is preferably installed closely adjacent thereto, and a separate motor is provided for movement of the nozzle 36 in each of the pitch and yaw directions 186 and 182 respectively which motor is preferably closely adjacent a respective yoke 175 and 174 respectively for movement of the nozzle 36.

Each of the motors must be capable of putting out a high power of perhaps 1 horsepower during its duty cycle in order to effectively operate its corresponding aerofin or nozzle. In order to provide such an output, a high voltage of perhaps 150 volts or more is required. However, in order to prevent such a motor from overheating from the resulting high wattage when such a voltage is applied, the motor must conventionally undesirably be made too large to effectively save any space in the missile. However, for use in a tactical missile which is built to be destroyed usually within about five minutes after launch, it is only necessary to prevent the motor from overheating so that it is operable during the duration of the missile flight. Thus, a motor which overheats and becomes inoperative after that period of time due to high wattage would be satisfactory. This would then allow the motor to be built more compactly for the short service life required. In accordance with the present invention, a power source, preferably a single battery, is provided for supplying high voltage electrical power to all of the nozzle and fin motors. For the purposes of this specification and the claims, the term "high voltage" is defined to mean that voltage which would cause the motor to which it is supplied to provide the desired power output for at least about five minutes but would cause the motor to which it is supplied to overheat and become inoperative after about ten minutes or less of continuous operation. Thus, the motors may be sized smaller than would be desired in conventional applications to provide a compact nozzle and aerofin actuation system 52.

Figure 7:
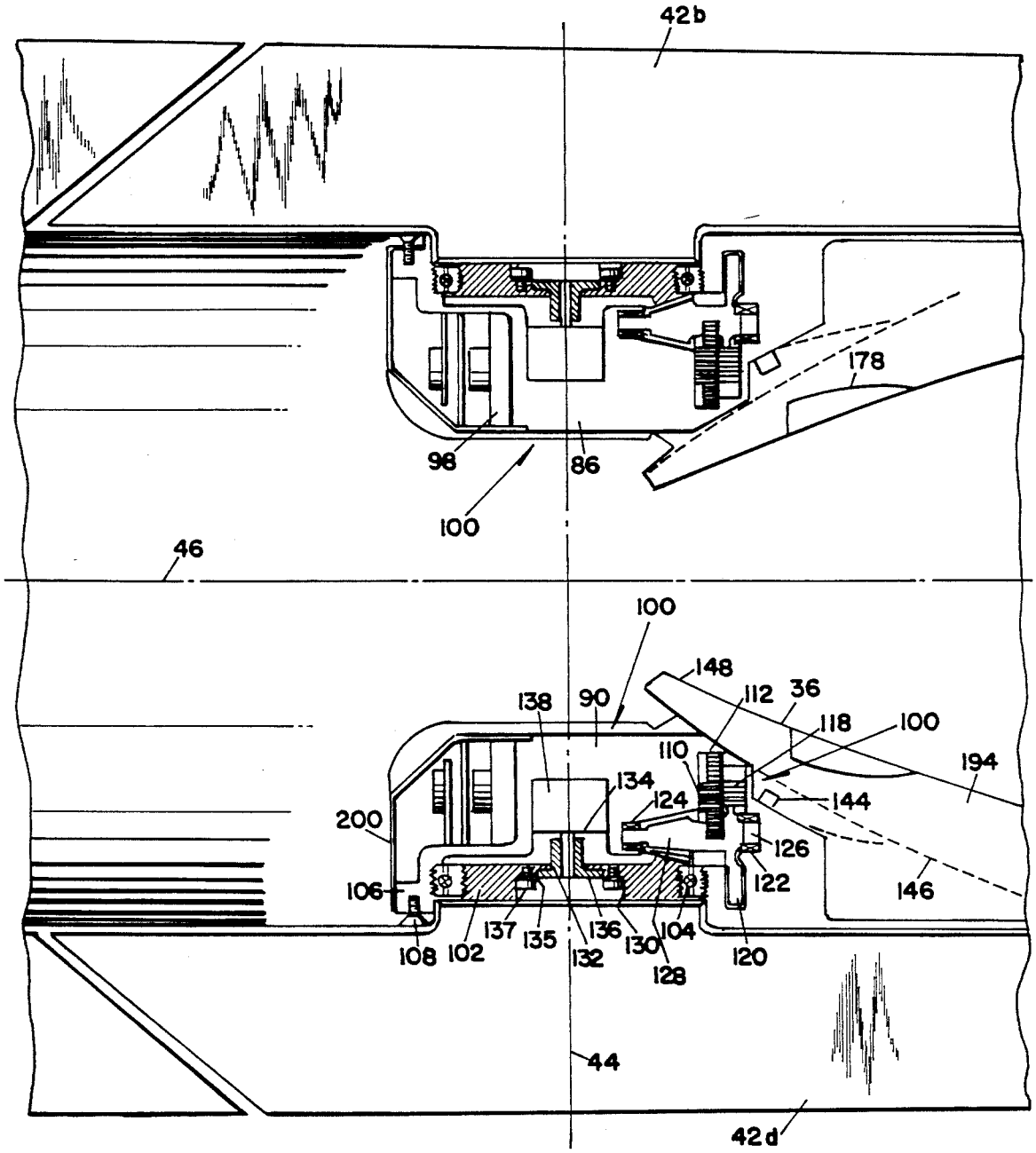
FIG. 7 is a detailed longitudinal view illustrating the aerofin actuator system for the missile of FIG. 3.
Figure 8:
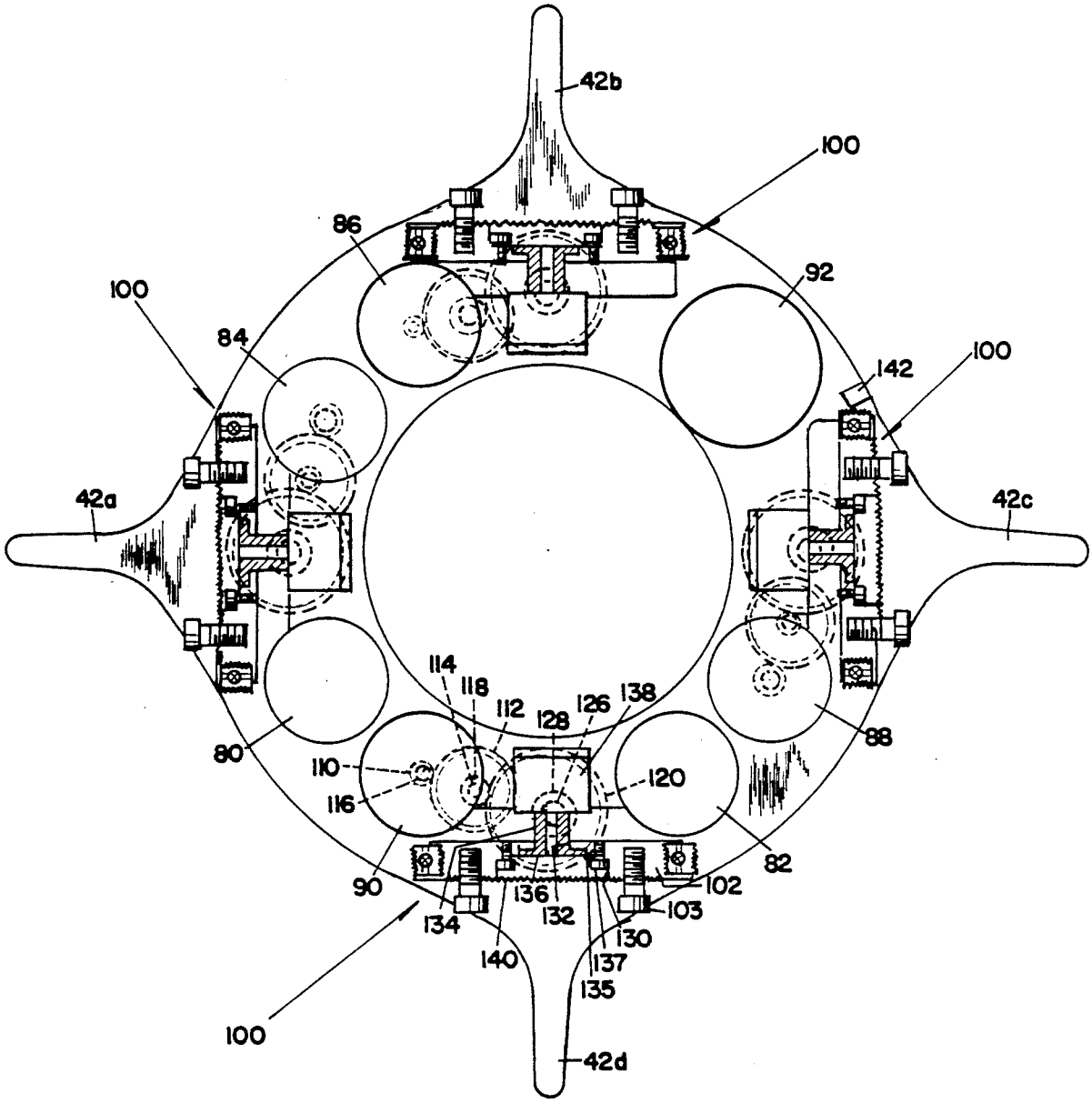
FIG. 8 is a detailed end view illustrating the aerofin actuator system for the missile of FIG. 3.
Figure 9:
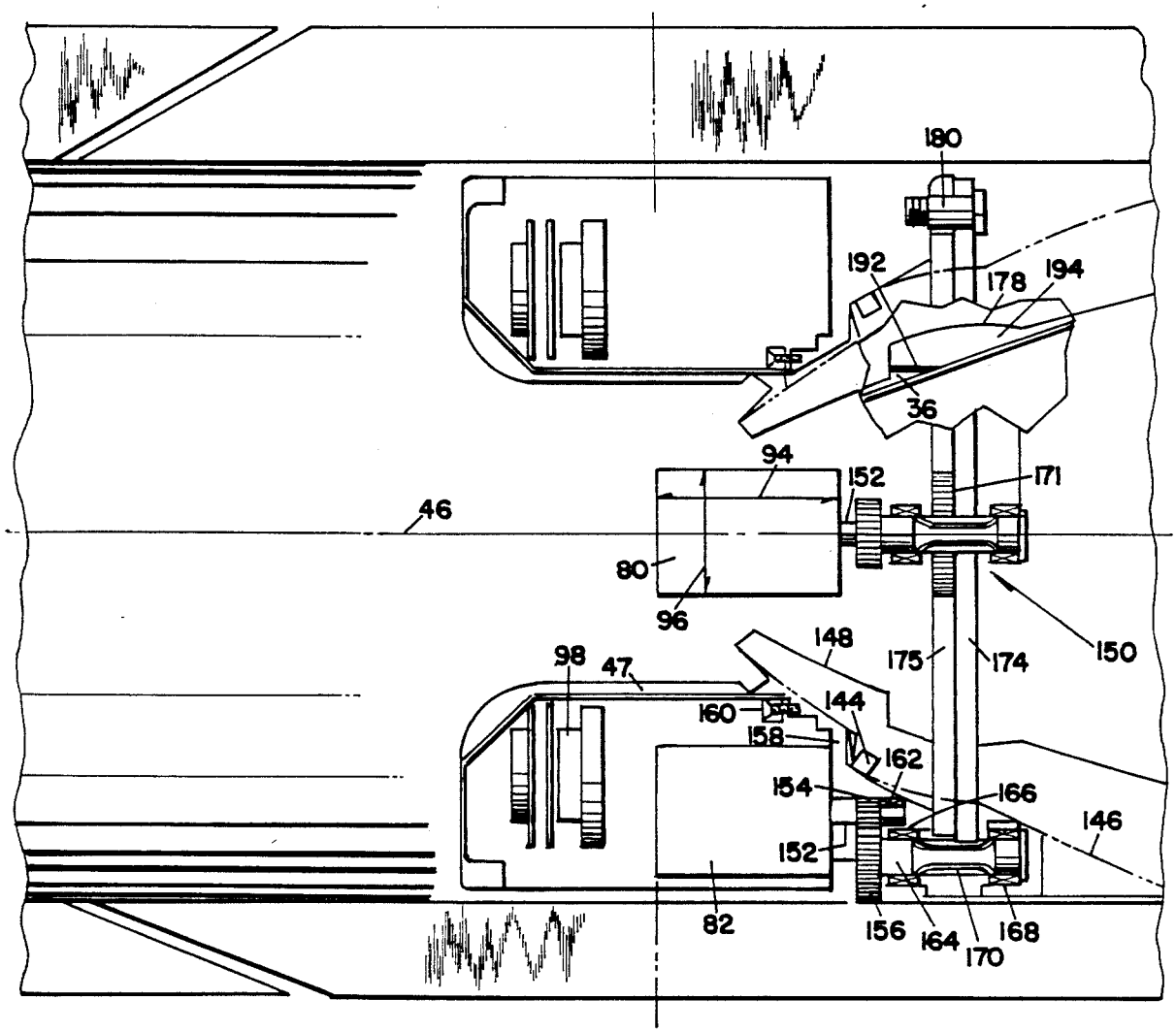
FIG. 9 is a detailed longitudinal view illustrating the thrust vector actuator system for the missile of FIG. 3.
Figure 10:
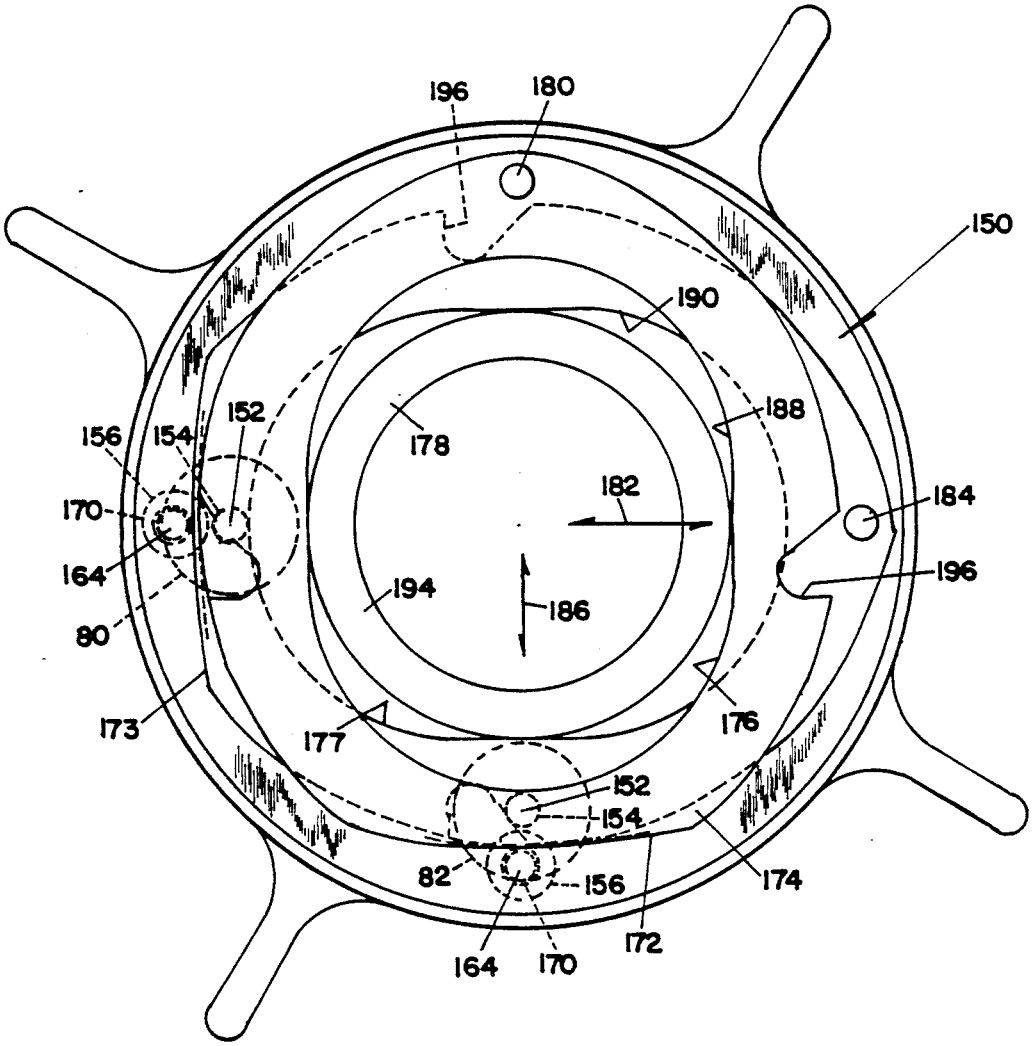
FIG. 10 is a detailed end view illustrating the thrust vector actuator system for the missile of FIG. 3.

Referring to FIGS. 7 to 10, there are shown detailed views of the actuation system 52, the portion thereof for actuating the aerofins 42 being shown most clearly in FIGS. 7 and 8 and the portion thereof for actuating the nozzle 36 being shown most clearly in FIGS. 9 and 10. The actuation system 52 comprises six direct current motors two of which are illustrated at 80 and 82 for movement of the nozzle 36 omniaxially and four of which are illustrated at 84, 86, 88, and 90 for movement respectively of the four aerofins 42. Each of the aerofin motors is closely adjacent its respective aerofin, as shown in FIG. 8, in order to eliminate a large amount of space taking linkage which would otherwise be required if a single motor were provided for all the aerofins or if the motors were positioned further from their corresponding aerofins. Thus, motor 84 is provided for aerofin 42*a*, motor 86 is provided for aerofin 42*b*, motor 88 is provided for aerofin 42*c*, and motor 90 is provided for aerofin 42*d*. Motor 80 is the pitch direction servo motor for movement of yoke 175, and motor 82 is the yaw direction servo motor for movement of yoke 174, the pitch and yaw directions 186 and 182 respectively being perpendicular to each other. In order to eliminate space taking linkage, motors 80 and 82 are closely adjacent the corresponding yokes 175 and 174 respectively (hereinafter described) which they operate. In order to further save space and provide an even more compact size to the actuation system 52, all of the motors are powered by a single battery illustrated at 92.

Each of the motors 80, 82, 84, 86, 88, and 90, which may have a length illustrated at 94 in FIG. 9 of perhaps 2.3 inches and a diameter illustrated at 96 in FIG. 9 of perhaps 1.5 inches, is preferably a three phase Y-connected neodymium-iron-boron permanent magnet brushless motor. The motors for both the nozzle 36 and aerofins 42 are similar because the load conditions are similar to thereby result in cost savings. The brushless construction is inside-out when compared to conventional brush type motors. The windings are in a fixed stator housing while the rotor is composed of permanent magnet pole pieces. Commutation is achieved electronically instead of mechanically using a sensor on the rotor to monitor position, logic circuits in the electronic control units, illustrated at 98 in FIGS. 7 and 9, to decode the position, and transistors to switch the three coils on and off at the right times to set up the desired relationship between current flow in the wires and the magnetic field of rotating magnet poles. The brushless construction is provided so that each motor may have no brush wear for high reliability, low maintenance, no arcing, no contamination problems, higher possible speeds, and consequently a higher horsepower to weight ratio. In addition, a brushless motor may be packaged smaller. The windings are located in the stator to give better thermal dissipation because the stator, being an integral part of the frame and mounting brackets, acts as a heat sink. The permanent magnet rotor is smaller and lighter than its wound counterparts, and the lower inertia contributes to fast dynamic response. The use of neodymium-iron-boron material in the magents is provided to result in higher power density than samarium cobalt as well as lower cost due to the greater availability. Each motor is constructed to put out an instantaneous peak power of over one horsepower during its short duty cycle when supplied with high voltage of perhaps 150 volts.

The battery 92 comprises a molten lithium anode, an iron disulfide cathode, and an inorganic salt electrolyte of lithium and potassium chlorides, with thermal energy provided by mixture of iron powder and potassium perchlorate. The electrolyte remains non-conductive until a squib ignites the heat source which then instantly melts the electrolyte and makes it conductive. Such a battery, which may have an energy density greater than that of stored gas in a fluid power blow down system, may supply a peak current of about 50 amps at a minimum loaded voltage (peak power) of perhaps 90 volts. Nominal battery voltage may be perhaps 175 volts at a load of about 1.1 amps. Thus, the battery 92 is capable of supplying high voltage to the motors so that each of the motors has an output of over 1 horsepower. 80 cells in series, each perhaps 1.6 inches in diameter and 0.055 inch in length, may make up the battery to result in a high power, lightweight (perhaps 0.1 pounds per cubic inch) battery with high reliability and a storage life of greater than perhaps ten years. The battery 92 may be located between the nozzle and fin actuator motors as the interface permits. If necessary and suitable, it can alternately be located between the cylindrical motor case 14 and the air frame. The battery 92 may thus be compact to have a length perhaps between about 5.46 and 6.73 inches and a diameter of perhaps about 1.86 inches.

Referring to FIGS. 7 and 8, there are shown the portions of the actuation system 52 which comprise the actuators, illustrated generally at 100, for each of the aerofins 42. The aerofin actuator 100 for aerofin 42*d* will be discussed hereinafter, each of the other aerofin actuators 100 being similar thereto. The aerofin 42*d* is suspended from and fixedly attached to platform bevel gear 102 by suitable means such as screws 103 for movement about radial axis 44. The bevel gear 102 is mounted for rotation within ball bearing 104 which is itself mounted within the motor mount 106 in which the motor 90 is suitably mounted. The motor mount or housing 106 is suitably attached to the case 14 by suitably means such as screws 108. The mating faces of the aerofin 42*d* and platform gear 102 are splined as illustrated at 140, that is, they are each provided with meshing teeth, to thereby allow the teeth to take the load to provide a firm fin mount to prevent undesirable flutter of the fin 42*d*. A suitable thin film thermal insulator may be provided between the teeth of the splined faces 140 to prevent overheating of the actuator apparatus 100.

The motor 90 is operatively connected to the bevel platform gear 102 by a triple-reduction gear train as follows. A spur gear 110 on the motor shaft 116 is caused to suitably mesh with reduction spur gear 112 for rotation thereof. Gear 112 is mounted on shaft 114 which is suitably mounted by any conventional means for rotation. Mounted on shaft 114 is gear 118 which is structurally integral with gear 112 and which is caused to suitably mesh with spur reduction gear 120 for rotation thereof. Gear 120 is mounted on shaft 126 which is mounted in roller or needle bearings 122 and 124 for rotation therein. Also mounted on shaft 126 is bevel tapered gear 128 which is structurally integral with gear 120 and positioned to suitably mesh with the bevel platform gear 102 for rotation thereof for rotating the aerofin 42*d* about the radial axis 44. Thus, the individual compact motor 90 is connected to the fin 42*d* through a triple-reduction gear for operation thereof without the requirement of weight and space consuming linkages.

In the radially outer surface of the platform gear 102 is a circular slot 130 which is generally coaxial with gear 102. An aperture 132, which is coaxial with gear 102, extends through the platform gear 102 in communication with the slot 130. Disposed in the aperture 132 is a shaft 134 which is fixedly mounted to the platform gear 102 for rotation coaxially therewith by a flange 136 which is received within the slot 130 and is fixedly held in the slot 130 for rotation with the platform gear 102 by retainer 135 and screws 137. The shaft 134 is suitably connected to and in communication with the potentiometer or feedback transducer 138 for providing feedback information thereto as to the position of the aerofin 42*d* as will be described in greater detail hereinafter. At 142 is illustrated an electrical connector unit for ground testing and checkout. A rubber insert or soft stop 144 may be provided in the surface of the nozzle 36 at a point where it may touch other hardware in order to absorb shock when in the deflected position illustrated by dashed line 146.

Referring to FIGS. 9 and 10, there are shown the portions of the actuation system 52 which comprise the thrust vector actuation system generally illustrated at 150 for omniaxially moving the nozzle 36. Mounted on the shaft 152 of the yaw servo motor 82 is a gear 154 which is positioned to suitably mesh with spur reduction gear 156 for rotation thereof. The motor 82 is suitably mounted in motor mount 158 which is suitably attached to the nozzle housing 47 by suitable means such as screws 160, as more clearly shown in FIG. 12. The end of the shaft 152 for motor 82 is suitably received in roller bearing 162 for rotation thereof. Spur reduction gear 156 is mounted on shaft 164 which is suitably received, for rotation thereof, in a pair of roller bearings 166 and 168 which are suitably mounted in housing 158. Mounted on shaft 164 is a pinion gear 170 to which is suitably connected a feedback transducer (not shown) in accordance with principles commonly known to those of ordinary skill in the art to which this invention pertains. The gear 170 is suitably positioned to mesh with teeth (not shown) which are machined in the radially outer surface of a circular portion 172 of yaw yoke or driving plate 174 and which are similar to teeth 171 machined in a circular portion 173 of similar pitch yoke or driving plate 175 for the pitch servo motor 80. The pitch servo motor 80 is geared to pitch yoke or driving plate 175 similarly as yaw servo motor 82 is geared to yaw yoke or driving plate 174.

The driving plates 174 and 175 may be characterized as large sector gears with elongated holes in the middle provided by elongated inner surfaces 176 and 177 respectively. The driving plates or yokes 174 and 175 are arranged so that the inner surfaces 176 and 177 are elongated to have flat portions or flats 188 and 190 respectively in directions which are perpendicular to each other as best shown in FIG. 10. The exit cone 194, which is threadedly attached as illustrated at 192 to the nozzle 36, has a generally spherical cam surface illustrated at 178 which is received within and engaged by the elongated portions or flats 188 and 190 respectively of the inner surfaces 176 and 177. Each of the yokes 174 and 175 is suitably pivotable about pivot pins 180 and 184 respectively, each pivot pin positioned circumferentially 180° from the circular teeth portion 172 and 173 respectively of its respective yoke 174 and 175 to cause movement of the yaw yoke 174 in the yaw direction 182 to cause the flat 188 to force the nozzle 36 to rotate in the yaw direction 182 about its pivot point when the yaw yoke 174 is moved about pivot 180 by gear 170 when initiated by motor 82 and to cause the pitch yoke 175 to pivot about its pin 184 for movement of the flat 190 in the pitch direction 186, which is perpendicular to the yaw direction 182, to force the nozzle 36 to rotate in the pitch direction 186 about its pivot point when initiated by motor 80. The exit cone spherical seat 178 is pivotable about the central point, the center as previously discussed of a trapped ball (not shown) at the throat, whereby a combination of movements of the yaw and pitch yokes 174 and 175 respectively in the yaw and pitch directions 182 and 186 respectively will cause pivotal movement of the nozzle 36 omniaxially by perhaps as much as 15° from its centered position illustrated at 148. Notches illustrated at 196 may be formed in the outer surfaces of the yokes 174 and 175 to avoid interference thereof with the pins 180 and 184 respectively. Actuation system 150 may, for example, allow a high gear reduction of about 120 to 1 between the motor shaft and exit cone center line. If desired, additional gear reductions may be provided to increase the gear reduction ratio to perhaps 500 to 1.

Assembly of each thrust vector actuation system 150 with the nozzle and exit cone may be accomplished using the threaded coupling illustrated at 192 in FIG. 9 (not illustrated in FIG. 12). The actuators and drive plate mechanism 150 as well as aerofin actuators 100 are first installed over the nozzle assembly 36 after which the exit cone 194 is screwed in.

Since an individual motor is provided for each yoke, weight and space taken up by linkage thereto may be advantageously eliminated. The yokes advantageously do not apply any significant axial force to the nozzle. An antirotation device is advantageously not required to constrain the nozzle from rotating about the center line. The thrust vector actuation system 150 may for example have a mechanical efficiency of about 90 percent compared to typically 70 percent for other means such as ball screws. The use of individual small motors powered by high voltage, as discussed hereinbefore, which are closely adjacent their respective driven mechanisms may, for example, reduce the weight and volume over conventional actuation devices by as much as perhaps 50 percent. By the time such small motors have been overheated by the high power density due to the high voltage, they will have completed their task.

Figure 11:
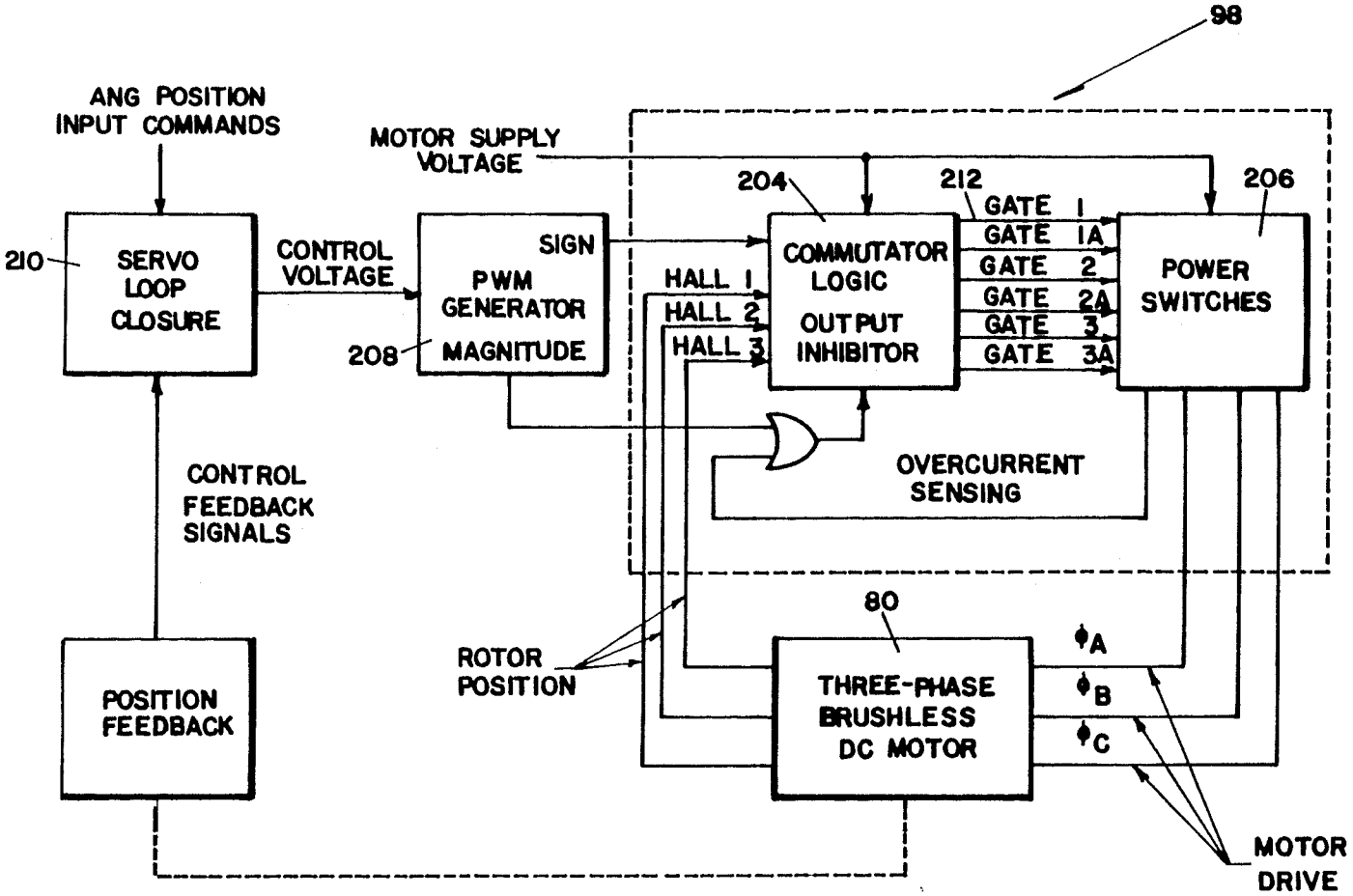

Extending annularly around the radially inner surface of the case 14 just forward of the motors is a housing 200 for the single electronics control unit 98. Referring to FIG. 11, there is shown a block diagram of the electronics control unit 98. Conventional solid state high power components are used in the circuits. The electronics control unit 98 comprises a commutation logic section 204, power switches 206, pulse with modulation (PWM) logic section 208, and a servo loop closure section 210. While only one motor 80 is shown in the diagram, it is to be understood that the single electronics control unit 98 is meant to serve all of the motors 80, 82, 84, 86, 88, and 90. In the commutation logic section 204, bipolar latched Hall-effect sensors, which magnetically detect position, are used to monitor rotor position. Discrete logic gates 212 then decode the position and send switching signals to the power stage 206. As the bipolar transistors get hot, they may tend to lose control and cease to function properly. The power transistor switches 206 use conventional metal oxide semiconductor field effect transistor (MOSFET) technology to lend thermal stability for immunity to thermal runaway. PWM logic, which provides high frequency pulses of current to power switches and also to the motor so that it may run cooler and more efficiently and also results in a slight back and forth movement to maintain lubrication to keep undesirable microwelds from occurring in parts, is used in the forward loop, i.e., the signal which is a summation of the command signal and actual position signal which represents error which is modulated and then sent to the motor to correct the error, to achieve better thermal efficiency. Analog components, such as potentiometers or variable differential transformers 138 for position feedback and amplifiers for summing and compensation, may be used for the loop closure 210. The electronics control unit 98 may be provided in accordance with the above discussion using principles commonly known to those of ordinary skill in the art to which this invention pertains.

Thus, small individual motors for separately operating aerofins and nozzle yokes may be provided with high voltage power supply in accordance with the present invention for reduced space and weight so that both movable aerofins and a movable nozzle for thrust vector control may be provided in a pulsed tactical missile where space and weight are at a premium. Further reduction in space and weight may be achieved by providing a common electronic control unit for the individual motors. The actuation system 52 may, for example, have a weight of perhaps less than about 17 pounds. With a smaller fin span, a greater number of such tactical missiles may be packaged in a payload bay of an airplane.

It is to be understood that the invention is by no means limited to the specific embodiments which have been illustrated and described herein, and that various modifications thereof may indeed be made which come within the scope of the present invention as defined by the appended claims.

What is claimed is:

1. A missile comprising an elongate case having a forward end and an aft aperture and having a diameter which is less than about twenty inches, at least two separately ignitable solid propellant charges in said case for providing thrust for at least two pulses respectively, means for igniting each of said solid propellant charges, a thrust nozzle mounted to said case in communication with said aft aperture and movable for guiding the missile when thrust is provided, at least two electromechanical actuator means for pivotally moving said nozzle for guiding the missile, a plurality of aerodynamic surface means extending outwardly from and spaced about said case for stabilizing and providing lift to the missile and each of which has a span which is less than about four inches, each of said aerodynamic surface means includes a movable fin, an individual electromechanical actuator means for each of said fins for moving thereof for guiding the missile, and means for supplying high voltage electrical power to each of said nozzle and fin electromechanical actuator means.

2. A missile according to claim 1 wherein said power supply means comprises a single thermal battery for supplying power to all of said nozzle and fin actuator means.

3. A missile according to claim 1 wherein each of said nozzle and fin actuator means includes a brushless direct current motor.

4. A missile according to claim 1 wherein each of said nozzle and fin actuator means includes a rare earth permanent magnet brushless direct current motor.

5. A missile according to claim 1 wherein each of said aerodynamic surface means has a span which is greater than a first span wherein there would be no side force on the missile at burnout and less than a second span wherein there would be no side force on the missile at launch.

6. A missile according to claim 1 wherein each of said aerodynamic surface means has a span such that the required side force to hold the missile at a desired attitude at burnout is the same magnitude and opposite direction as the required side force on the missile at launch.

7. A missile according to claim 1 wherein said case diameter is less than about fifteen inches.

8. A missile according to claim 1 further comprising a housing attached to said case for mounting of said nozzle and a flexible bearing between said nozzle and said housing.

9. A missile according to claim 8 further comprising means including an elastomeric material between and bonded to said housing and said nozzle for preventing the ingestion of exhaust and debris into the space between said housing and said nozzle.

* * * * *